US005716718A

United States Patent [19]

Lai

[11] Patent Number: 5,716,718

[45] Date of Patent: Feb. 10, 1998

[54] ALUMINUM MESH WITH INTERLACED HOLLOW AND SOLID RIBS

[76] Inventor: Ching-Ming Lai, 12F-2, No. 112, Chung Shan North Road, Section 2, Taipei, Taiwan

[21] Appl. No.: 664,413

[22] Filed: Jun. 17, 1996

[51] Int. Cl.[6] ..... E04C 2/42; E04C 2/08

[52] U.S. Cl. ..... 428/577; 428/586; 428/596; 52/670; 52/672

[58] Field of Search ..... 428/586, 596, 428/577; 52/635, 670, 672

[56] References Cited

U.S. PATENT DOCUMENTS

| | | | |
|---|---|---|---|
| 948,414 | 2/1910 | Clark | 52/670 |
| 1,080,418 | 12/1913 | Clark | 52/670 |
| 1,427,246 | 8/1922 | Waller | 52/670 |
| 1,578,416 | 3/1926 | Frease | 52/670 |
| 2,406,557 | 8/1946 | Nagin | 52/670 |
| 5,181,410 | 1/1993 | Lai | 72/256 |

*Primary Examiner*—John J. Zimmerman
*Attorney, Agent, or Firm*—Bacon & Thomas

[57] ABSTRACT

An an aluminum mesh with interlaced hollow and solid ribs. The hollow ribs thereof define large open spaces of the aluminum mesh and the solid ribs thereof further define small open spaces within each large open space, providing the aluminum mesh with varied patterns formed from the interlaced hollow and the solid ribs in only one single stretching operation.

3 Claims, 14 Drawing Sheets

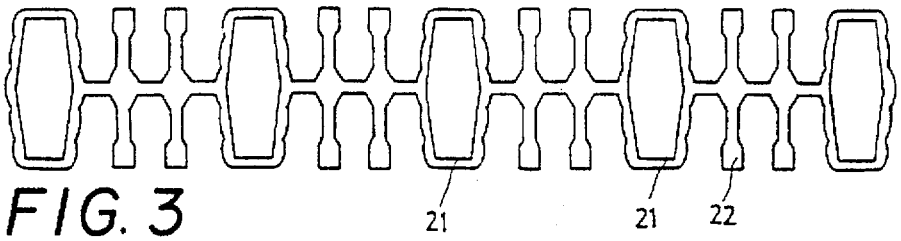
FIG. 3
FIG. 4
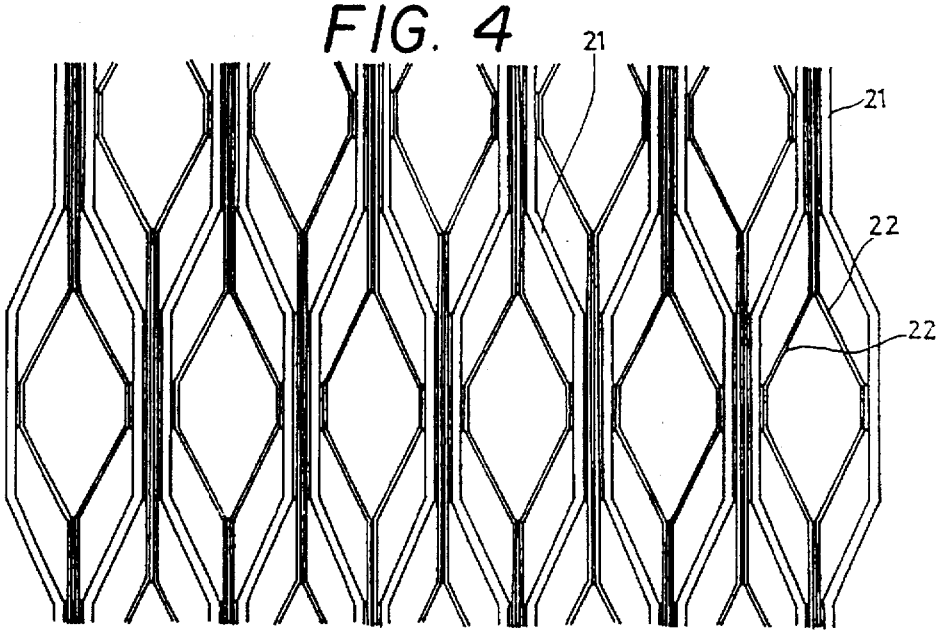
FIG. 5
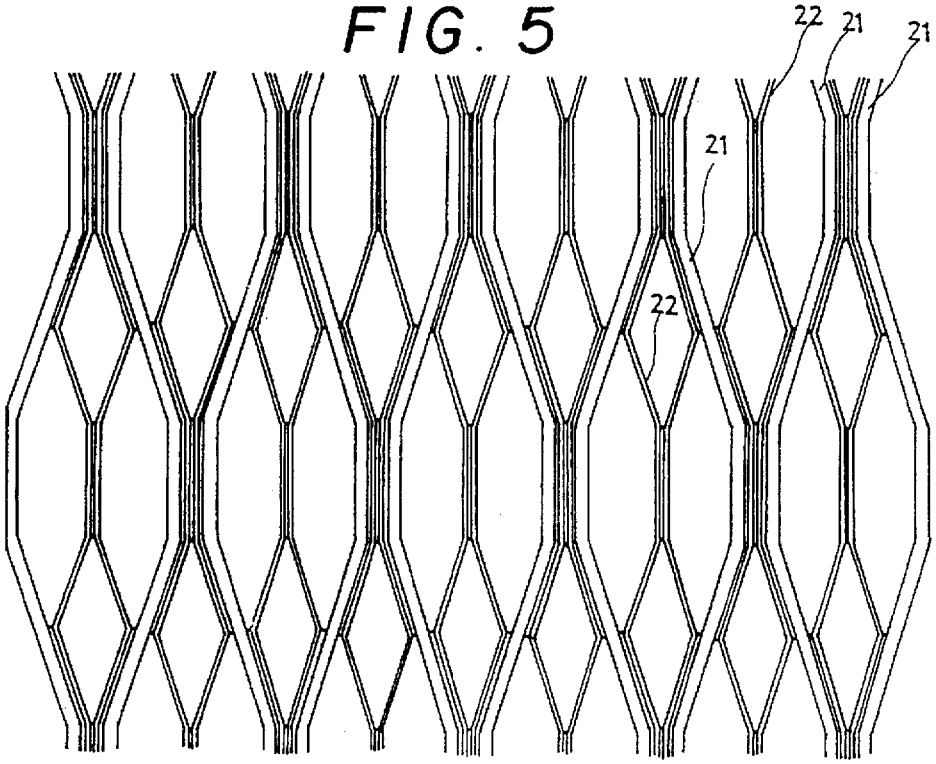

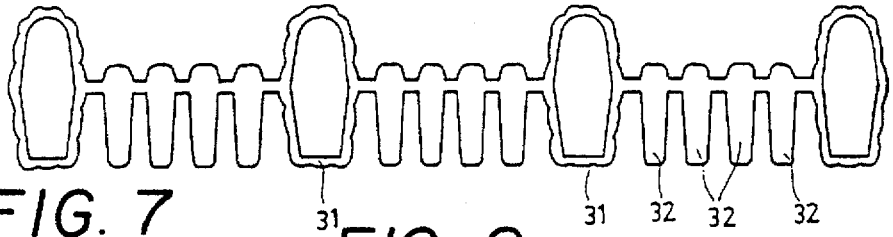
FIG. 7
FIG. 8
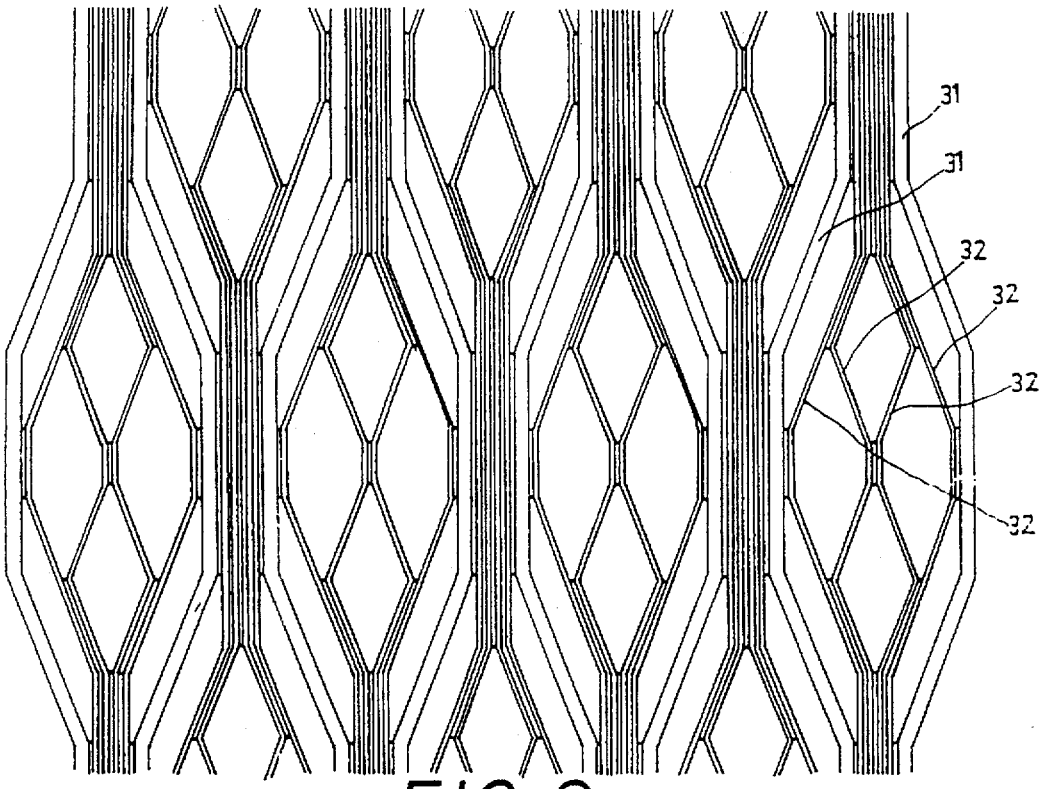
FIG. 9
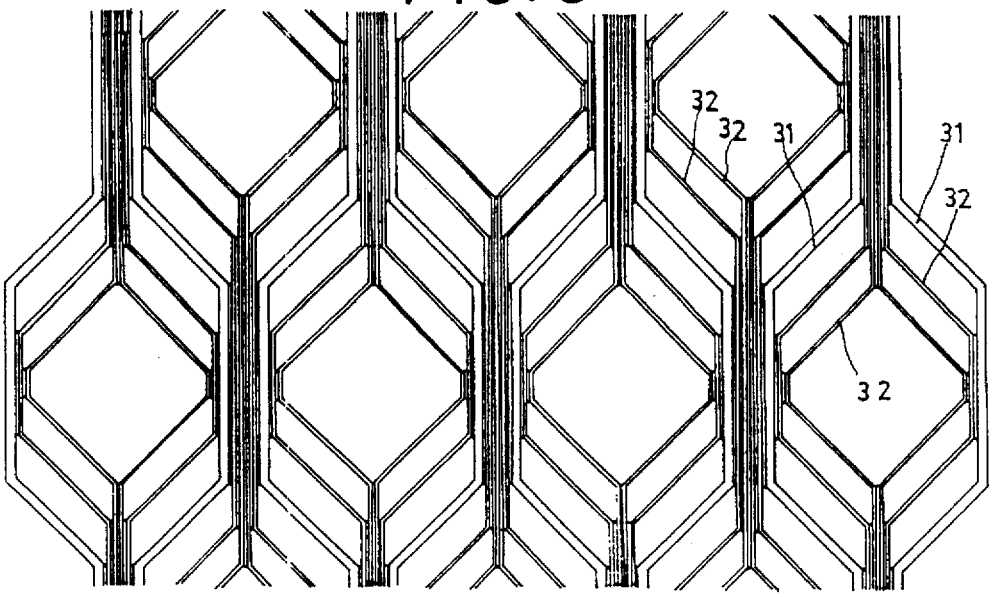

ALUMINUM MESH WITH INTERLACED HOLLOW AND SOLID RIBS

BACKGROUND OF THE INVENTION

The present invention relates to an aluminum mesh with interlaced hollow and solid ribs, and more particularly to an aluminum mesh which can be integrally formed to have different patterns formed from the interlaced hollow and solid ribs.

Various kinds of aluminum meshes are presently available in the markets. The method of forming such aluminum meshes was initially developed by an Australia manufacturer and was granted British Patent Nos. 1,601,015; 1,600,947; and 1,588,197; and Japanese Patent Nos. 22,462; 7,264; 36,108; 24,021; and 13,186. These patents disclose the apparatus and methods for producing aluminum meshes. According to these known methods and apparatus, an extruded aluminum panel is slotted by a slotting machine and is then stretched by a mesh stretching machine to form the mesh. The aluminum meshes can be easily produced in this manner at lower cost and in large quantity, while there are a variety of patterns which can be designed and formed for the meshes. This is an advantage of the aluminum meshes that can not be found on other metal meshes and is widely welcomed by the consumers. The early aluminum meshes comprised only solid ribs which are in the form of slender rods or strips. The solid ribs may have different thicknesses and the strip-form ribs can be designed to provide additional functions, such as to serve as a sunshade. The disadvantage of the aluminum meshes with solid ribs lies in that they are functionally limited after they are integrally formed and therefore could not completely replace the meshes made of stainless steel or any other metal tubes, especially when the meshes are to be used with a door, a window, or a balcony rail as a security means, or to be used as a chair seat or other supporting surfaces which need a larger contact surface. This is because the solid ribs of the aluminum meshes formed by extruding aluminum alloys usually have a small diameter and therefore a small peripheral area which permits the aluminum meshes to only have a limited pressure-bearing surface area. Further, the slender ribs are not so beautiful in their appearance as other metal tube materials. The aluminum meshes with solid ribs do not have the same effect as that provided by other metal tubes when they are used as the balcony rails and therefore can not be widely accepted and adopted. When the same amount of material is used to form a mesh with solid ribs, it provides less shearing or bending strength than that provided by meshes formed from hollow tubes which have increased peripheral surface and accordingly increased structural strength. This is the major factor preventing the patented aluninum meshes from widely replacing the conventional meshes made of metal tubes. That is why the meshes made of stainless steel pipes or other metal pipes are still widely accepted for various or other metal pipes are still widely accepted for various purposes even though their outer appearance will more or less be damaged by the welding process. With the larger diameter and the higher bending and shearing strength of the meshes formed from hollow tubes, consumers generally will select the meshes with hollow ribs rather than those with solid ribs. For example, in designing a complete set of window, factors such as the window frame, the window screen, the corner members, the assembling manner, the security function, and the appearance of the window will all be considered to meet the market requirements and the practical utility thereof. Since the aluminum meshes with solid ribs fail to meet the changing requirements in the markets in view of their structural strength and appearance, the inventor has developed an aluminum mesh with hollow ribs to improve the drawbacks existed in the aluminum meshes with solid ribs.

With the same amount of aluminum alloy, the so formed aluminum mesh with hollow ribs has higher shearing and bending strength than that of the aluminum mesh with solid ribs and is therefore more suitable for use with doors and windows as a security means, or with balcony rails as a protective and decorative means, or with chairs as a comfortable and durable seat. The hollow ribs may be reinforced by adding reinforcement to an inner space of the ribs. Threaded holes, etc. can be more easily formed on the hollow ribs to permit the meshes to be used for many more different purposes. Due to its significant uses, the aluminum mesh with hollow ribs is now increasingly welcomed by the consumers. Such aluminum mesh with hollow ribs developed by the inventor has been granted U.S. Pat. No. 5,181,410.

The aluminum mesh with solid ribs provides smaller and denser open spaces on the mesh but lower bending and shearing strength. The aluminum mesh with solid ribs can be easily damaged and a broken area thereof will cause the entire mesh to be useless. On the other hand, the aluminum mesh with hollow ribs provides higher bending and shearing strength and is therefore not easily stretched to form small open spaces as those on the mesh with solid ribs. The large open spaces on the aluminum mesh with hollow ribs reduce the security that can be provided by the mesh because anyone can easily extend a hand or a tool into the mesh through the large open space thereof to unlock a door or a window onto which the mesh is mounted. In brief, both the meshes with hollow and solid ribs are not perfect in view of their security function.

Furthermore, Since the hollow ribs have higher bending strength, the stretching of a slotted extruded aluminum panel with hollow ribs to form a mesh with hollow ribs has close relation with the sizes of slots formed on the panel and with the cross sectional area of each hollow rib, and is much more difficult than forming a mesh with solid ribs.

In order to form the aluminum mesh economically, the extruded aluminum panel is preferably stretched to permit every two adjacent hollow ribs thereof to space from each other by a suitable width. On the other hand, due to the higher bending strength of the hollow ribs, when a mesh with open spaces having a suitable width is to be formed, it is necessary to form the open spaces with longer longitudinal length to minimize possible deformation on the hollow ribs when the extruded aluminum panel containing hollow ribs is laterally stretched to form a mesh. As a result, the open spaces of the mesh with hollow ribs are always large and can form only somewhat monotonous patterns for the mesh. This will, of course, adversely affect consumer preference for the mesh with hollow ribs.

FIGS. 1 and 2 illustrate two conventional aluminum meshes 1 with hollow ribs 11 connected together by connecting strips 12 extending between them. The mesh is formed by first forming an extruded aluminum panel including hollow ribs 11 connected by connecting strips 12. The extruded aluminum panel is then laterally stretched by means of a mesh stretching machine to form the integral aluminum mesh 1 with hollow ribs 11. From the drawings, it can be seen that a plurality of open spaces 13 are formed after the extruded aluminum panel is stretched. The open spaces 13 are formed by forming slots on the connecting strips 12 before the aluminum panel is stretched. The dimensions of the open spaces 13 have close relation with the length of the slots and the strength of the ribs 11. As shown in the figures, the transverse width 14 of the open space 13 and the angle 15 contained by every two adjacent but stretched apart hollow ribs 11 are influenced by the strength of the ribs 11. Since the hollow ribs 11 have higher bending strength and are preferably kept undeformed with the extruded aluminum panel is laterally stretched, the angle 15 and the width 14 of the open spaces 13 are both limited to some extent. According to tests conducted on extruded aluminum panel with hollow ribs 11 having the cross sectional shape as shown in FIG. 1, the panel can be stretched to have a maximum angle 15 of about 36°. When the open spaces 13 have a predetermined width 14 to be reached, the slots for forming the open spaces 13 must have increased length. The increased length of the slots in turn increases the unit area of the open spaces 13. On the other hand, to economically produce the aluminum meshes, it is preferable that the extruded aluminum panel can be stretched to a maximum width available to form an integral piece of aluminum mesh. This ideal production condition, however, is very difficult to be realized in the production of the aluminum mesh with hollow ribs than in the aluminum mesh with solid ribs. The aluminum mesh with over-stretched hollow ribs shall have even larger open spaces defined between the hollow ribs that reduces the security that can be provided by the mesh while only monotonous patterns can be formed.

In the event the extruder aluminum panel is so stretched that the hollow ribs are separated beyond an acceptable extent, the hollow ribs shall deform or break due to their high bending strength and an angular potential differential at stretched corners (that is, the potential differential formed at two sides of the hollow ribs at their stretched corners), causing bad products. These are the drawbacks of the conventional aluminum meshes with hollow ribs in their manufacture and functions.

The hollow ribs 11 illustrated in FIG. 2 are reinforced by additional ribs provided inside the hollow ribs. The numbers of these reinforcing ribs can be changed according to the design of extrusion dies and the actual need in application and are not necessarily the same in all the hollow ribs.

SUMMARY OF THE INVENTION

It is therefore a primary object of the present invention to provide an aluminum mesh with interlaced hollow and solid ribs in which the aluminum mesh is integrally formed to contain large open spaces defined by the hollow ribs and small open spaces defined by the solid ribs within the large open spaces, so as to possess advantages provided by aluminum meshes with both solid ribs and hollow ribs.

Another object of the present invention is to provide an aluminum mesh with interlaced hollow and solid ribs which is formed from an extruded aluminum panel on which a plurality of hollow and solid ribs are linearly and parallelly arranged in different configurations, so that the formed aluminum mesh may have higher strength while showing varied patterns to meet the requirements of the markets.

A further object of the present invention is to provide an aluminum mesh with interlaced hollow and solid ribs wherein the hollow and the solid ribs have different cross sectional shapes to give the formed mesh different appearances for consumer choice.

The aluminum mesh as provided according to the present invention has interlaced hollow and solid ribs. The hollow ribs thereof define large open spaces of the aluminum mesh and the solid ribs thereof further define small open spaces within each large open space, providing an aluminum mesh with varied patterns formed from the interlaced hollow and solid ribs in only one single stretching operation. The aluminum mesh with interlaced hollow and solid ribs has the advantages of being easy to stretch, dense meshes, and varied patterns as provided by an aluminum mesh with only solid ribs and the advantages of higher shearing and bending strength as provided by an aluminum mesh with only hollow ribs.

BRIEF DESCRIPTION OF THE DRAWINGS

FIG. 3 is a fragmentary, cross-sectional view of the workpiece according to the first embodiment of the present invention before being stretched to form an aluminum mesh;

FIG. 4 is a fragmentary plan view showing the pattern of the aluminum mesh formed according to the first embodiment of the present invention;

FIG. 5 is a fragmentary plan view showing another pattern of the aluminum mesh formed according to the first embodiment of the present invention;

FIG. 7 is a fragmentary, cross-sectional view of the workpiece according to the second embodiment of the present invention before being stretched to form an aluminum mesh;

FIG. 8 is a fragmentary plan view showing the pattern of the aluminum mesh formed according to the second embodiment of the present invention;

FIG. 9 is a fragmentary plan view showing another pattern of the aluminum mesh formed according to the second embodiment of the present invention;

DETAILED DESCRIPTION OF THE PREFERRED EMBODIMENTS

Figure 1:
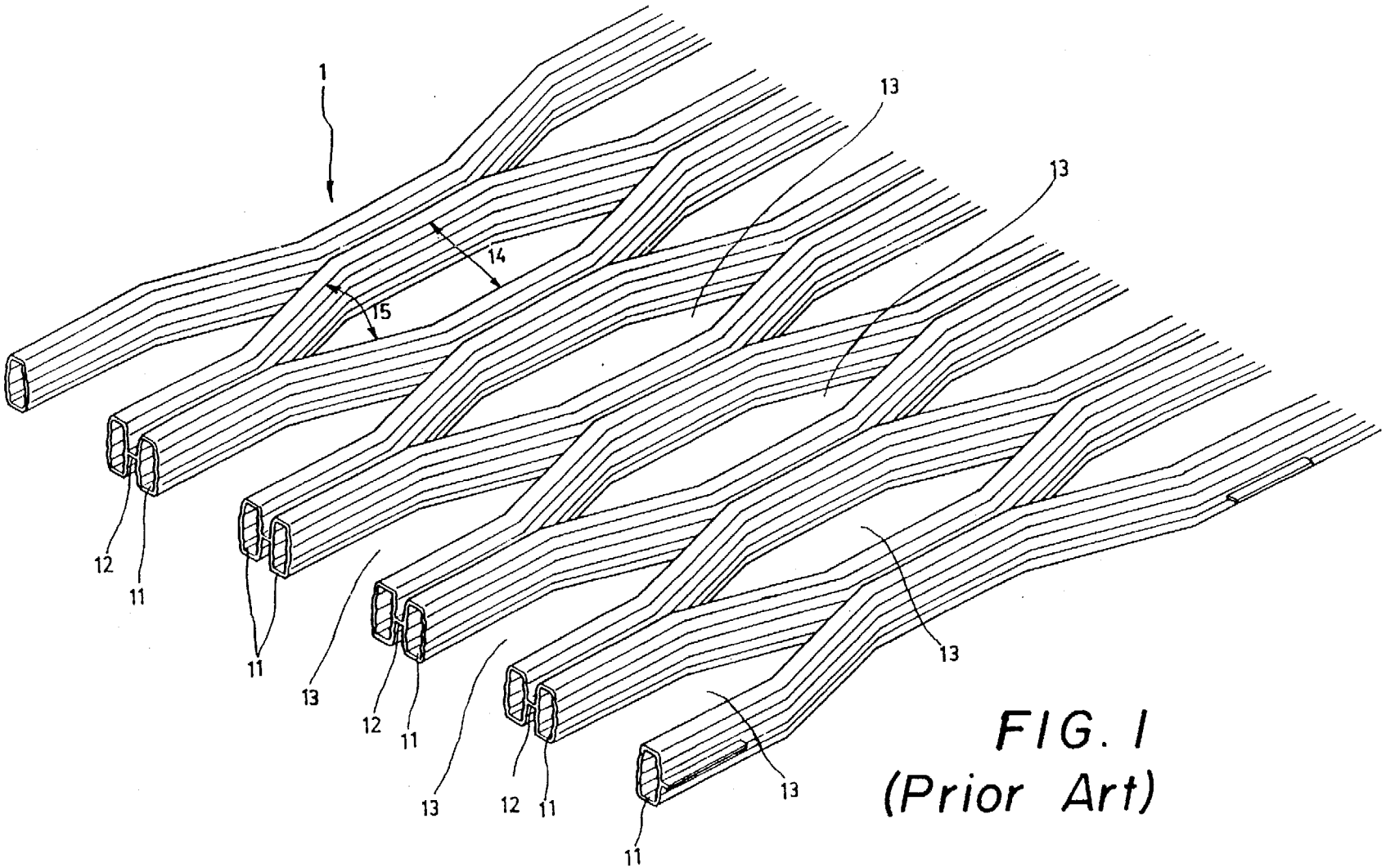
FIG. 1 (Prior Art)
FIG. 1 is a fragmentary perspective view of a conventional aluminum mesh with hollow ribs.
Figure 2:
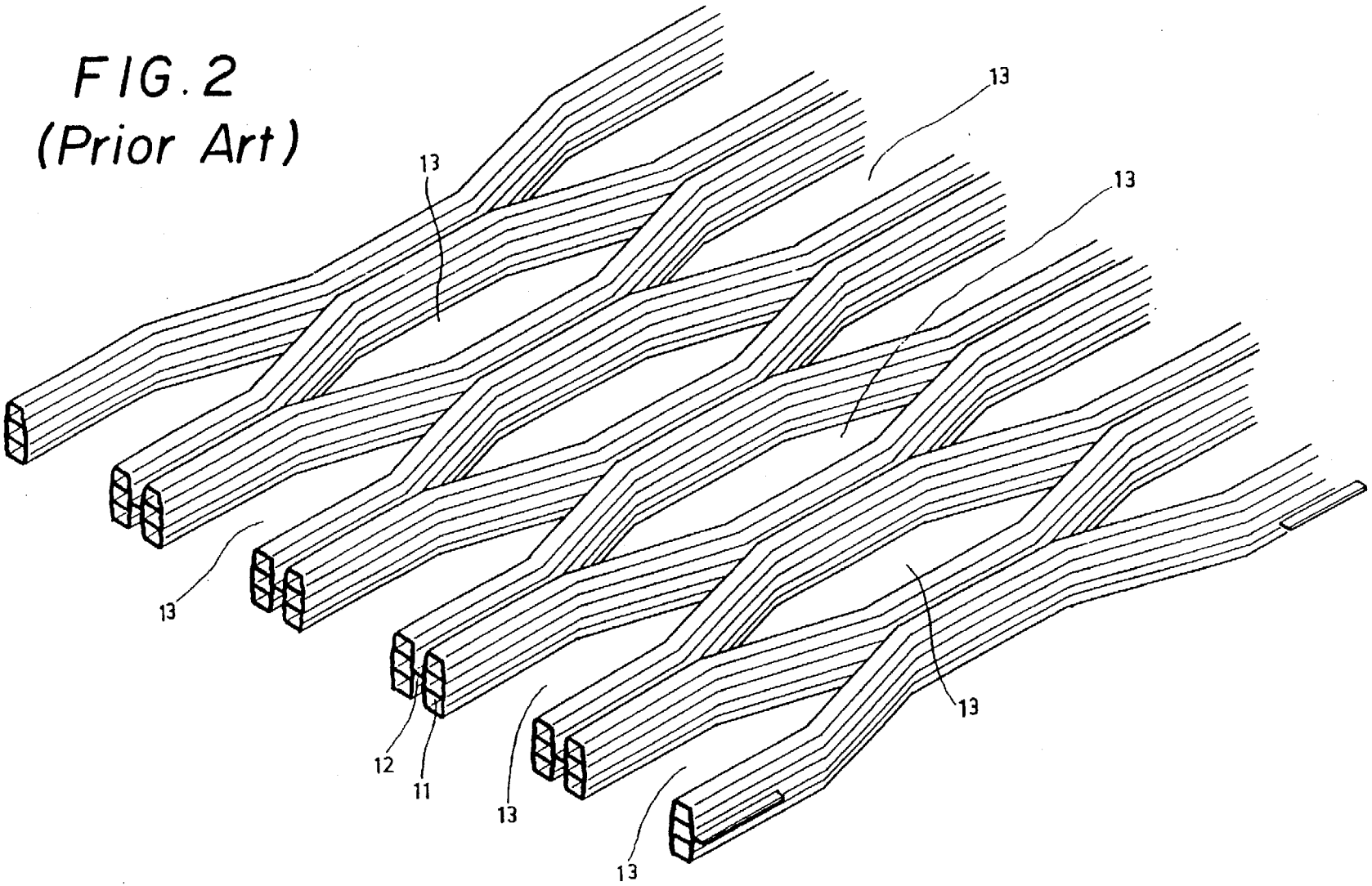
FIG. 2 (Prior Art)
FIG. 2 is a fragmentary perspective view of a conventional aluminum mesh with internally reinforced hollow ribs.
Figure 6:
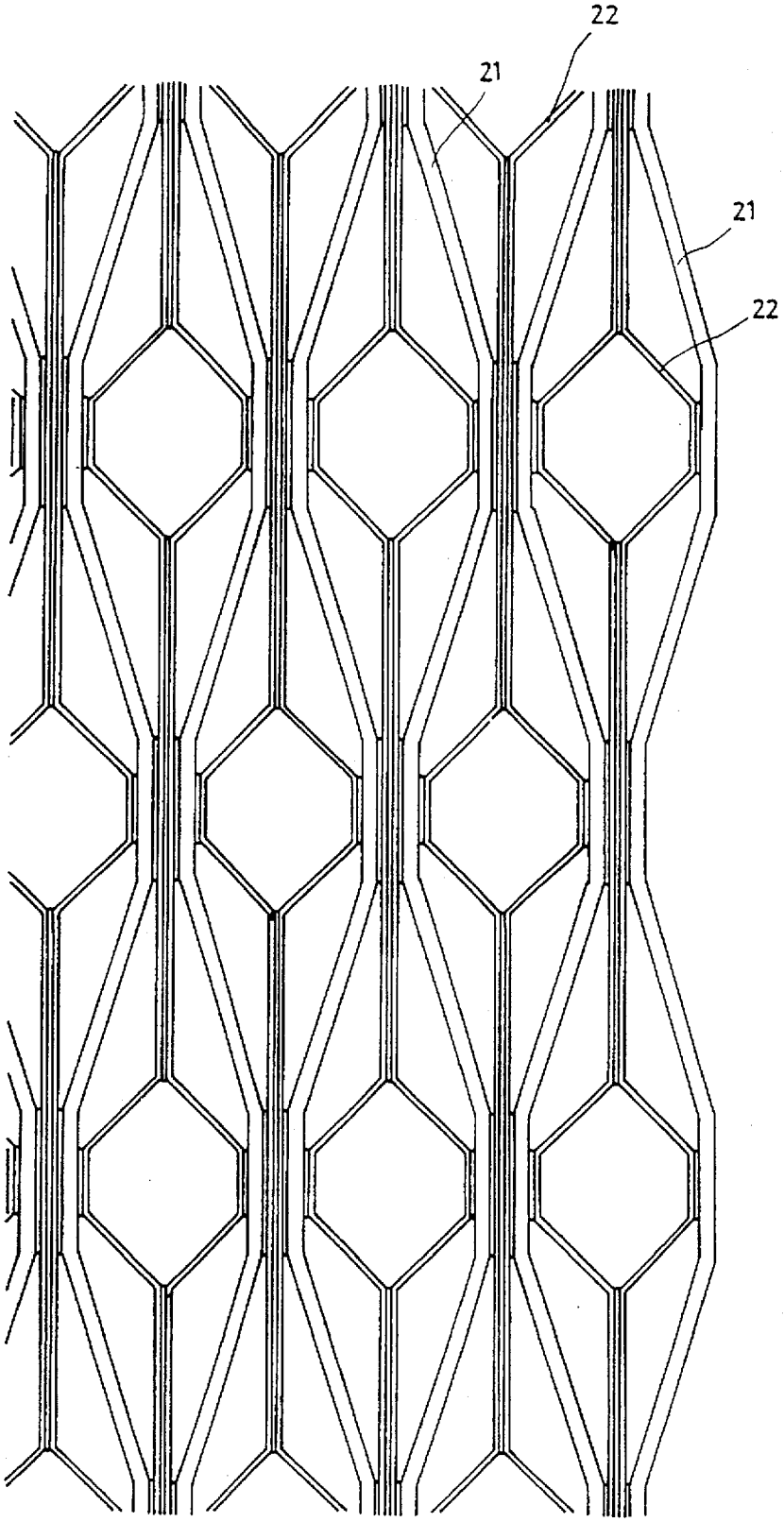
FIG. 6 is a fragmentary, elevational plan view showing still another pattern of the aluminum mesh formed according to the first embodiment of the present invention.
Figure 10:
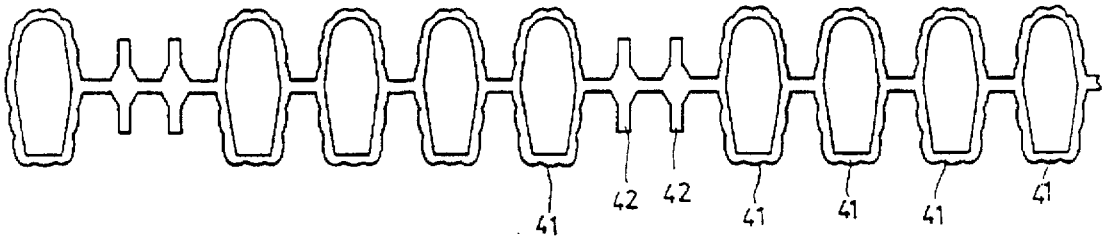
FIG. 10 is a fragmentary, cross-sectional view of the workpiece according to the third embodiment of the present invention before being stretched to form an aluminum mesh.
Figure 11:
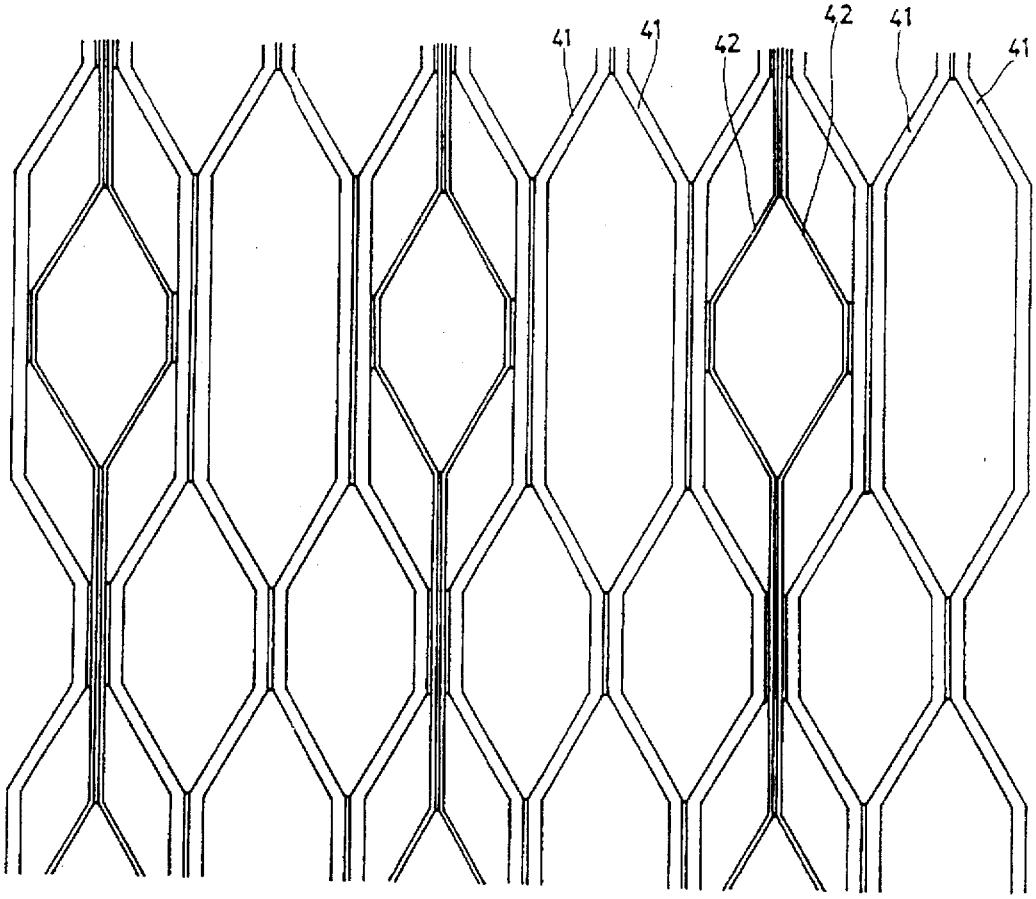
FIG. 11 is a fragmentary plan view showing the pattern of the aluminum mesh formed according to the third embodiment of the present invention.
Figure 12:
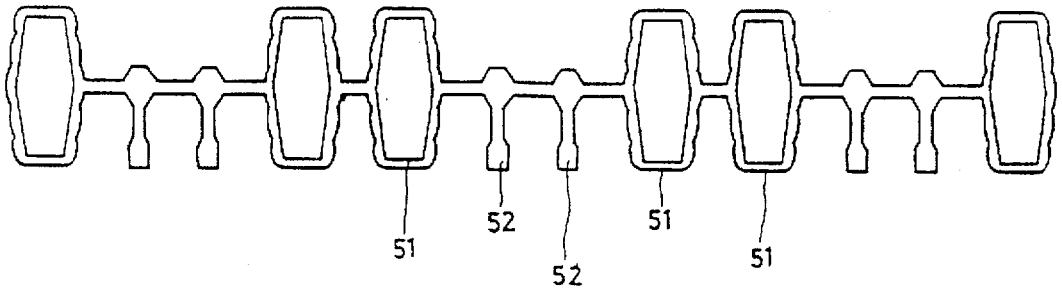
FIG. 12 is a fragmentary, cross-sectional view of the workpiece according to the fourth embodiment of the present invention before being stretched to form an aluminum mesh.
Figure 13:
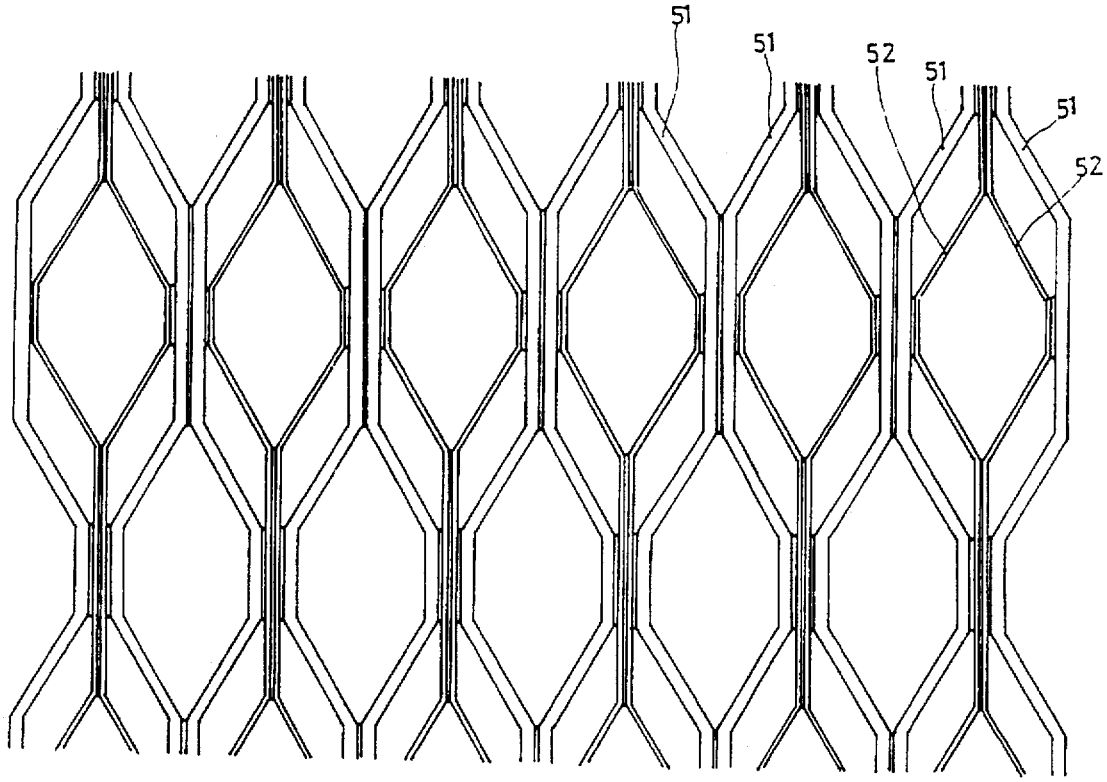
FIG. 13 is a fragmentary plan view showing the pattern of the aluminum mesh formed according to the fourth embodiment of the present invention.
Figure 14:
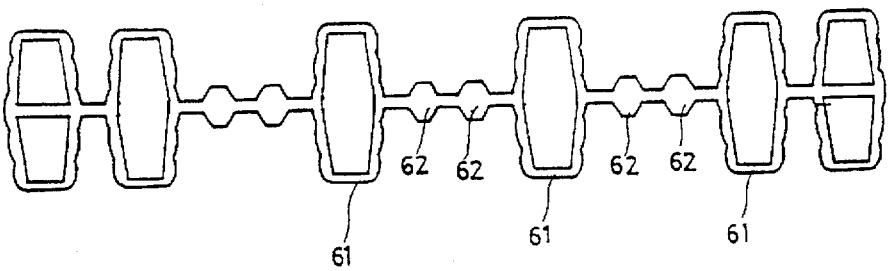
FIG. 14 is a fragmentary, cross-sectional view of the workpiece according to the firth embodiment of the present invention before being stretched to form an aluminum mesh.
Figure 15:
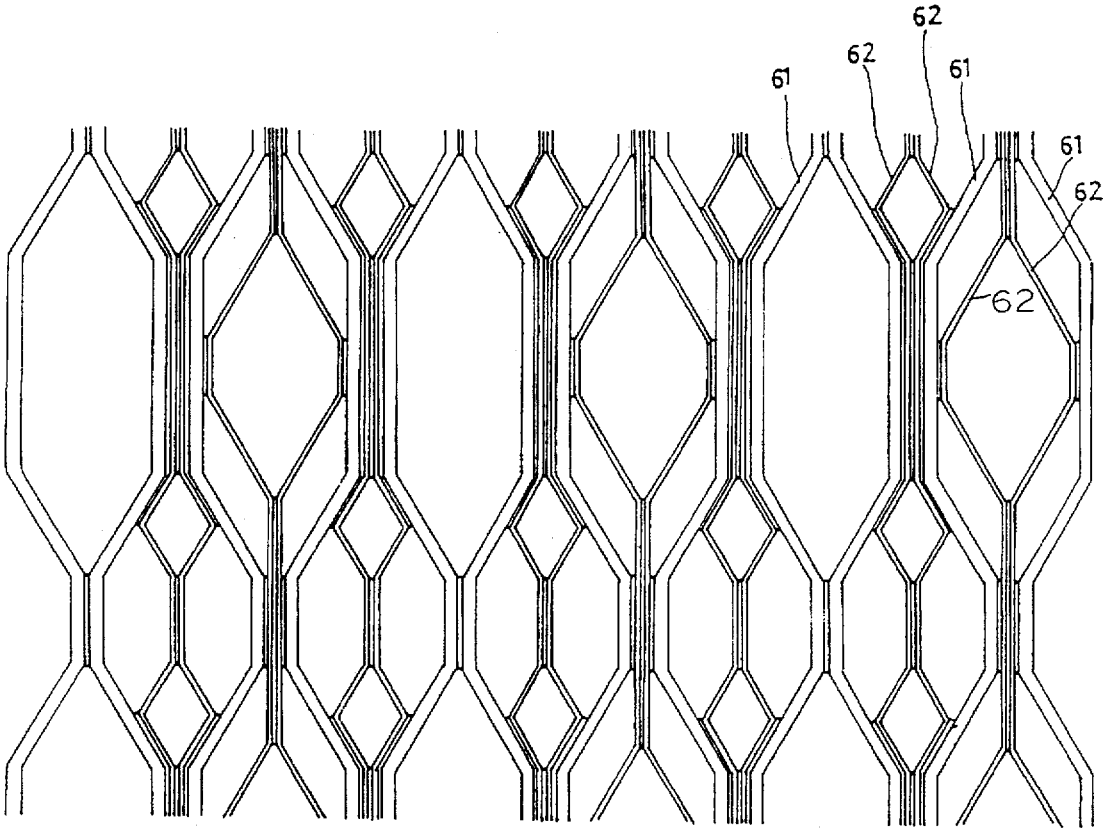
FIG. 15 is a fragmentary plan view showing the pattern of the aluminum mesh formed according to the fifth embodiment of the present invention.
Figure 16:
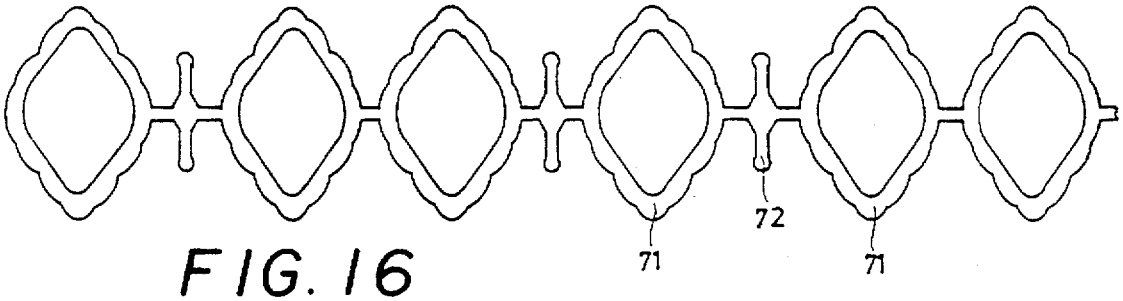
FIG. 16 is a fragmentary, cross-sectional view of the workpiece according to the sixth embodiment of the present invention before being stretched to form an aluminum mesh.
Figure 17:
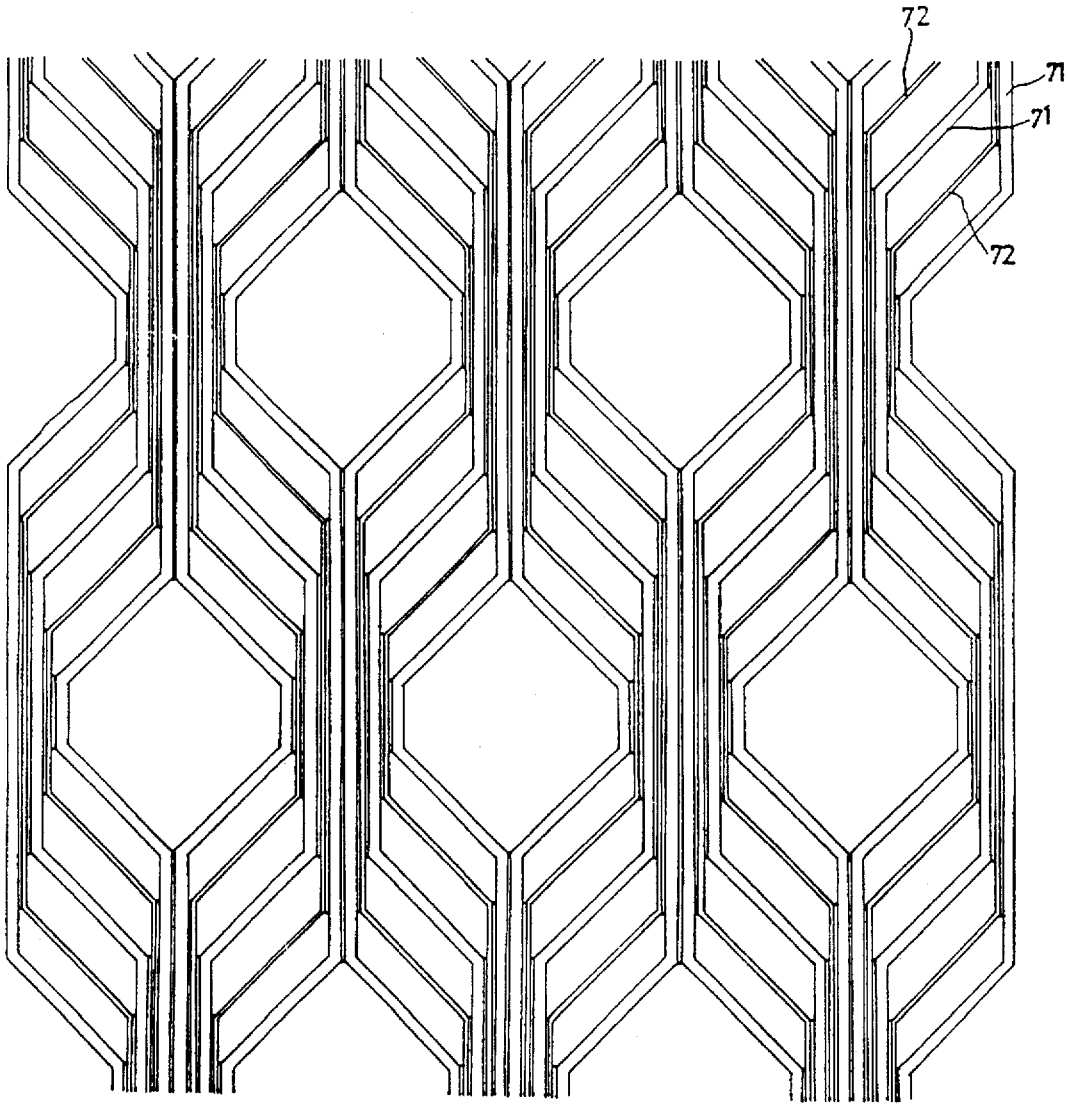
FIG. 17 is a fragmentary plan view showing the pattern of the aluminum mesh formed according to the sixth embodiment of the present invention.
Figure 19:
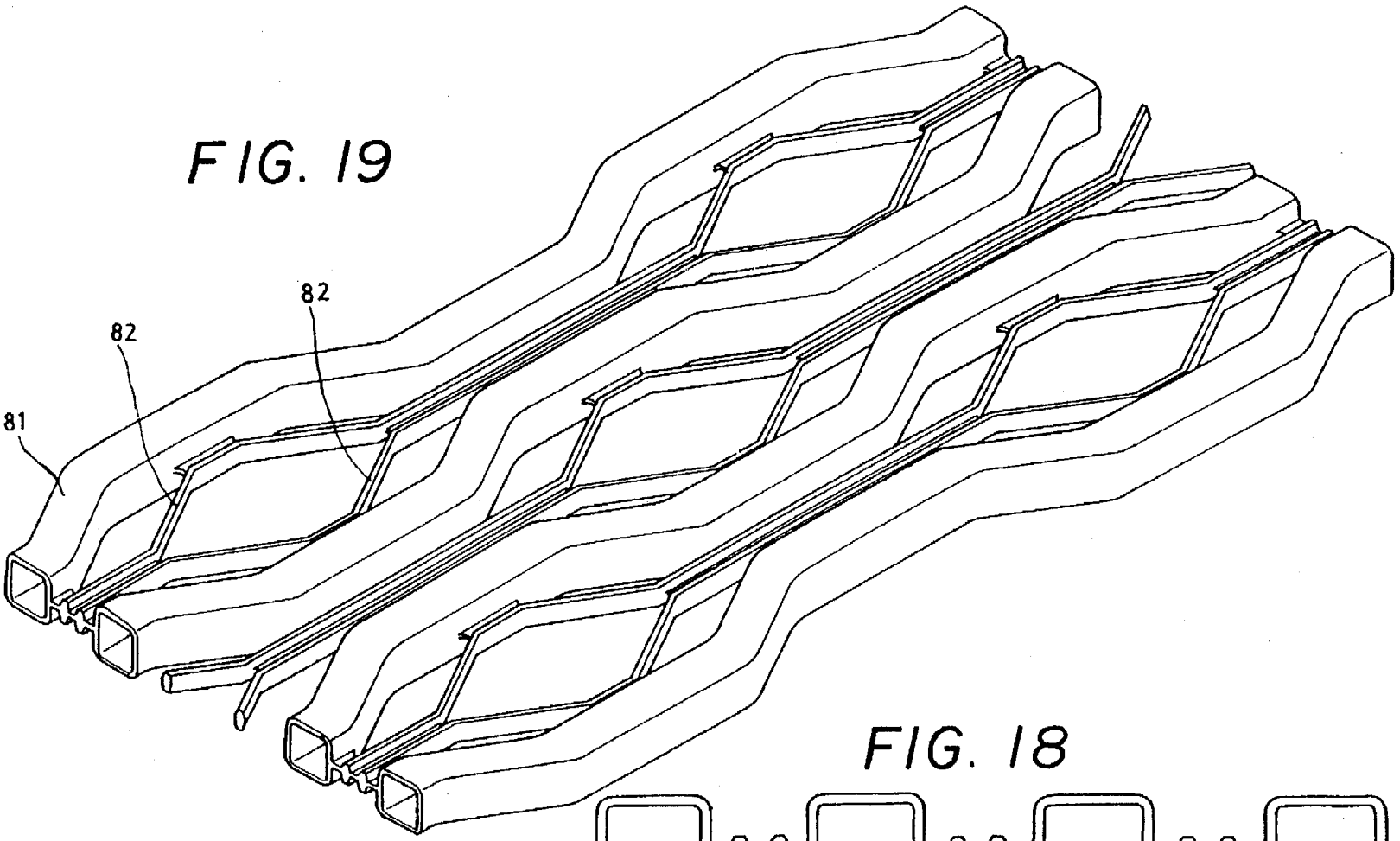
FIG. 19 is a fragmentary, perspective view showing the pattern of the aluminum mesh formed according to the seventh embodiment of the present invention.
Figure 18:
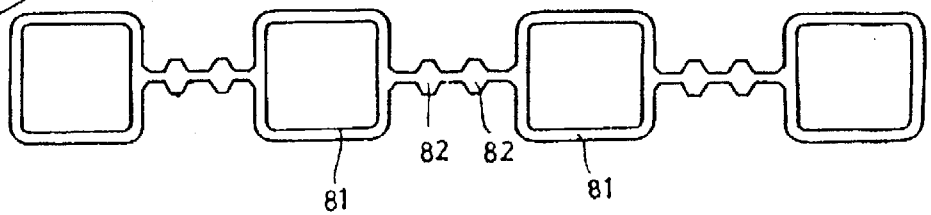
FIG. 18 is a fragmentary, cross-sectional view of the workpiece according to the seventh embodiment of the present invention before being stretched to form an aluminum mesh.
Figure 20:
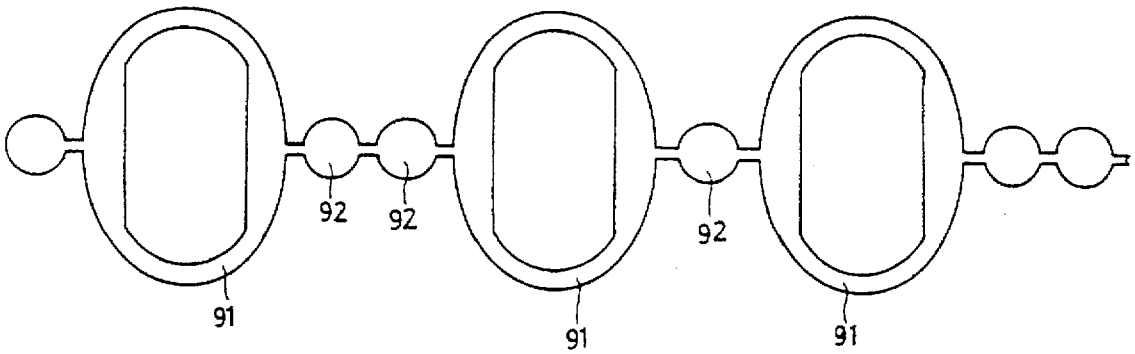
FIG. 20 is a fragmentary, cross-sectional view of the workpiece according to the eighth embodiment of the present invention before being stretched to form an aluminum mesh.
Figure 21:
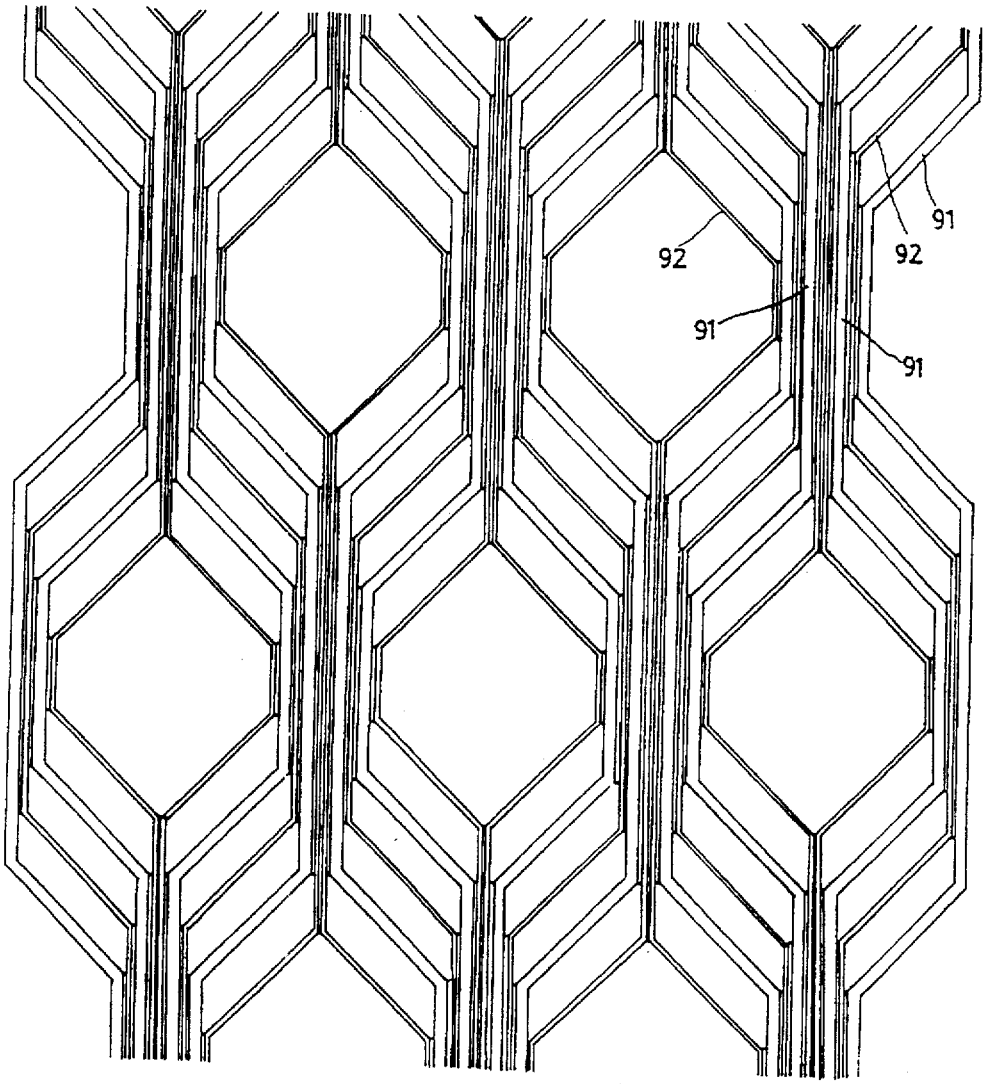
FIG. 21 is a fragmentary plan view showing the pattern of the aluminum mesh formed according to the eighth embodiment of the present invention.
Figures 22, 23:
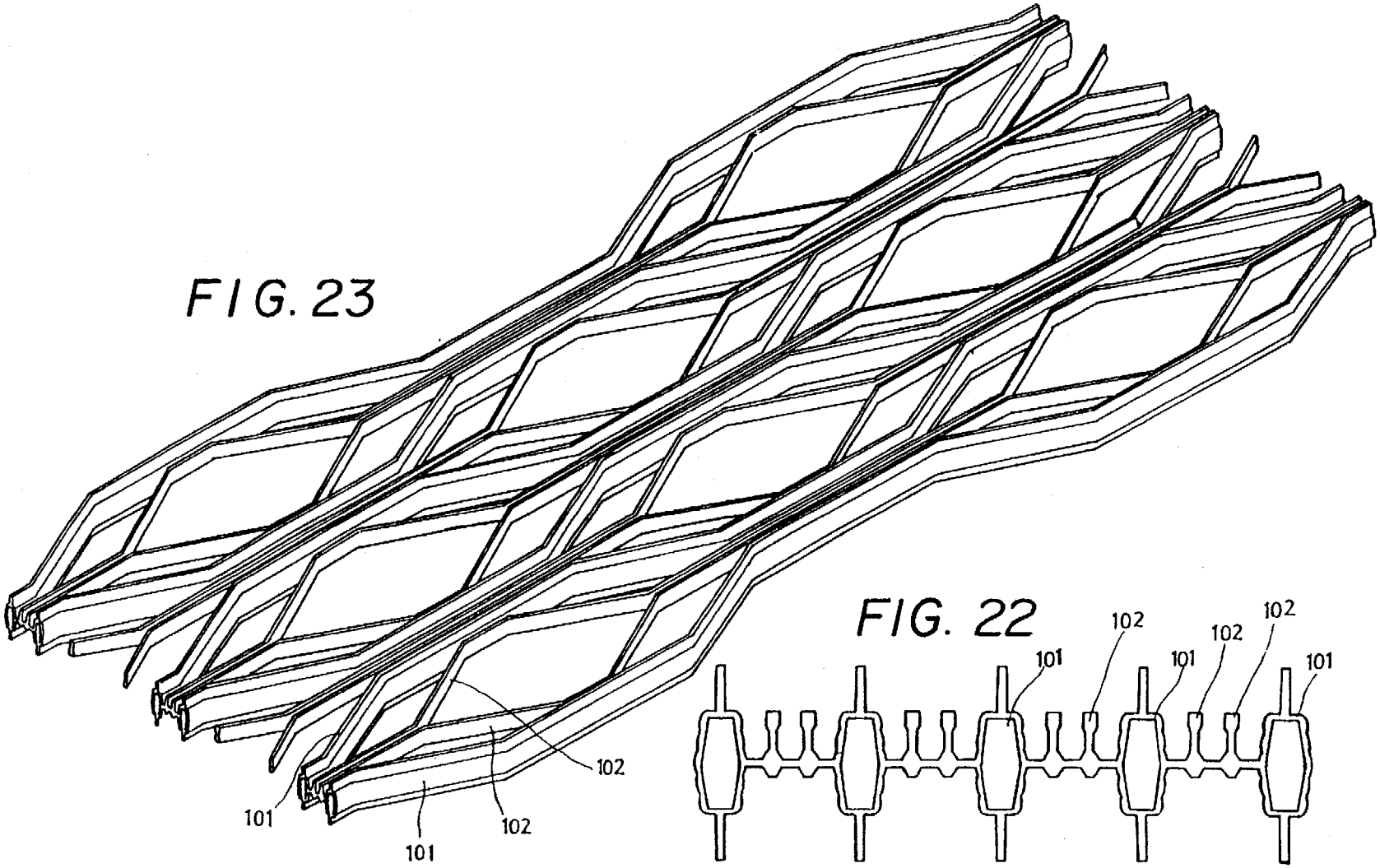
FIG. 22 is a fragmentary, cross-sectional view of the workpiece according to the ninth embodiment of the present invention before being stretched to form an aluminum mesh.
FIG. 23 is a fragmentary, perspective view showing the pattern of the aluminum mesh formed according to the ninth embodiment of the present invention.

The present invention relates to aluminum meshes with interlaced hollow and solid ribs which combine the advantages of easy to stretch, dense meshes, and varied patterns as provided by an aluminum mesh with solid ribs and advantages of higher shearing and bending strength as provided by an aluminum mesh with hollow ribs. Please refer to FIGS. 4, 5, 8, 9, 11, 13, 15, 17, 19, 21, 23, 25 and 17, in which different patterns formed from various embodiments of the aluminum meshes of the present invention are shown. As it can be seen from the respective drawings, hollow ribs 21, 31, 41, 51, 61, 71, 81, 91, 101, 111, and 121 form a plurality of large open spaces in a stretched workpiece, which is an extruded aluminum panel, with a somewhat monotonous pattern, while the solid ribs 22, 32, 42, 52, 62, 72, 82, 92, 102, 112, and 122 form a plurality of small meshes in each large open space formed from the hollow ribs. The small open spaces formed from the solid ribs may be in the same of in different shapes due to its easily stretchable nature. These identically or differently shaped small open spaces in the large open spaces can be achieved by forming and locating slots with specially designed lengths on connecting strips extending between every two ribs and then stretching the slotted extruded aluminum panel with a mesh stretching machine.

In the aluminum meshes with interlaced hollow and solid ribs as illustrated in FIGS. 3 through 27, the following differences exist in the patterns provided by these interlaced hollow and solid ribs:

a. Shapes of the small and the large open spaces respectively formed from the solid and the hollow ribs are different;

b. The small open spaces formed from the solid ribs may be formed within every large open space formed from the hollow ribs, or alternatively, be formed within every two large open spaces;

c. Both the hollow and the solid ribs may have a cross section having a shape being specifically designed to meet different structural requirements, such as a structure for attaching sunshades thereto;

d. Both the hollow and the solid ribs may have a generally non-limited longitudinal length, and the solid ribs may be provided to either one or two sides of each connecting strip; and e. Both the hollow and the solid ribs are not limited in their numbers; the hollow and the solid ribs are not necessarily sequentially alternately arranged but can be differently changed in their relative positions; and the hollow and/or solid ribs with identical cross sections can be stretched to form meshes in different patterns.

Although many different patterns and cross sections can be formed in the aluminum meshes with interlaced hollow and solid ribs, it is a fact as can be found from the practical experiences in manufacturing such aluminum meshes that having solid ribs symmetrically and uniformly formed and positioned in the open spaces formed from the hollow ribs shall favorably balance the stretching of the hollow ribs which have higher bending strength and thereby gives the formed aluminum mesh a more complete and beautiful pattern.

Figure 25:
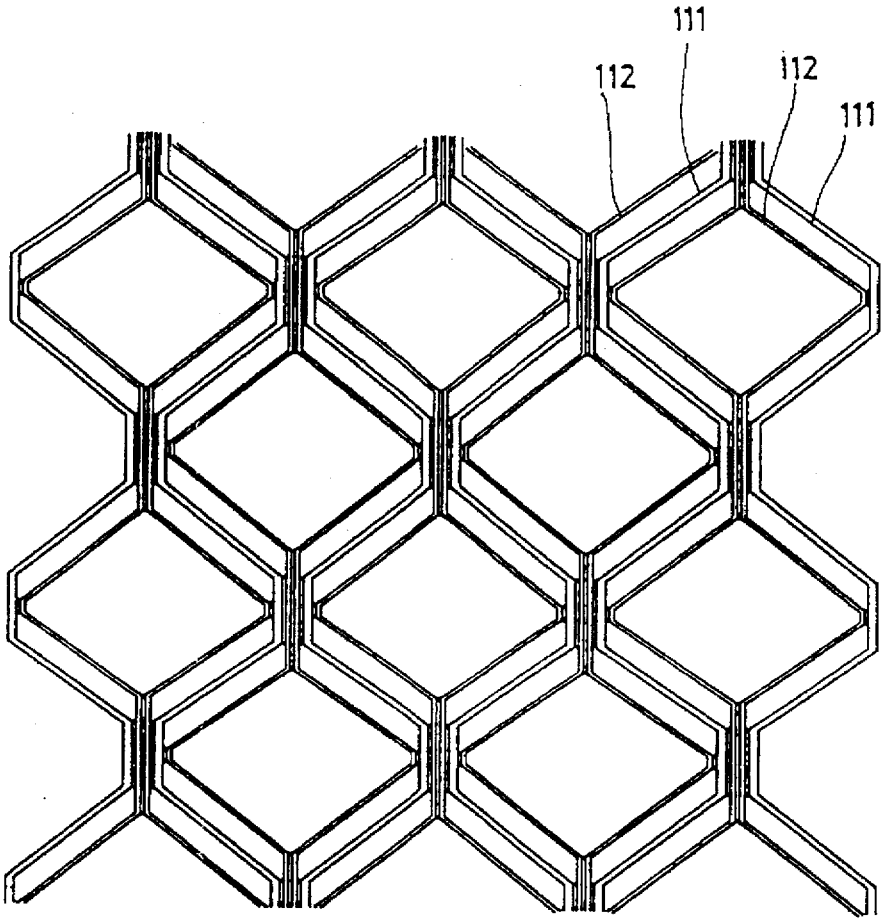
FIG. 25 is a fragmentary plan view showing the pattern of the aluminum mesh formed according to the tenth embodiment of the present invention.
Figure 24:
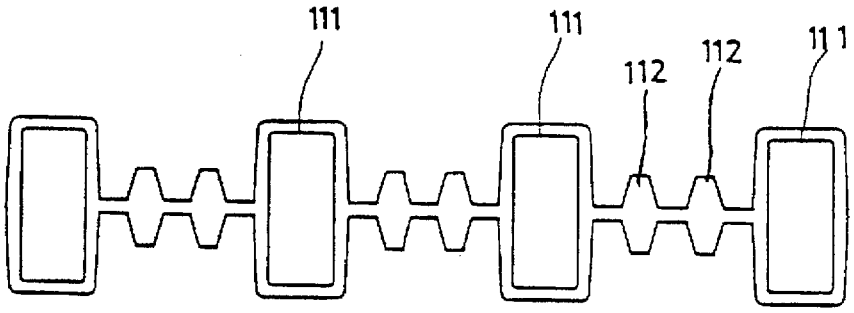
FIG. 24 is a fragmentary, cross-sectional view of the workpiece according to the tenth embodiment of the present invention before being stretched to form an aluminum mesh.
Figure 27:
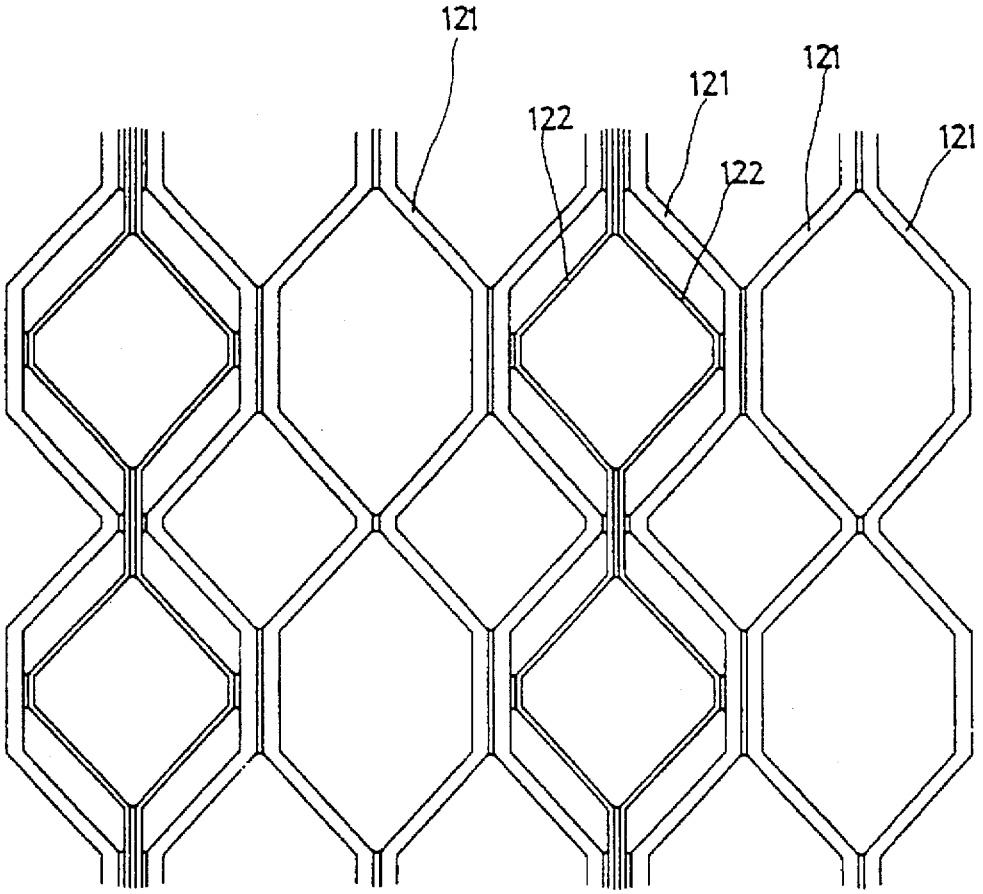
FIG. 27 is a fragmentary plan view showing the pattern of the aluminum mesh formed according to the eleventh embodiment of the present invention.
Figure 26:
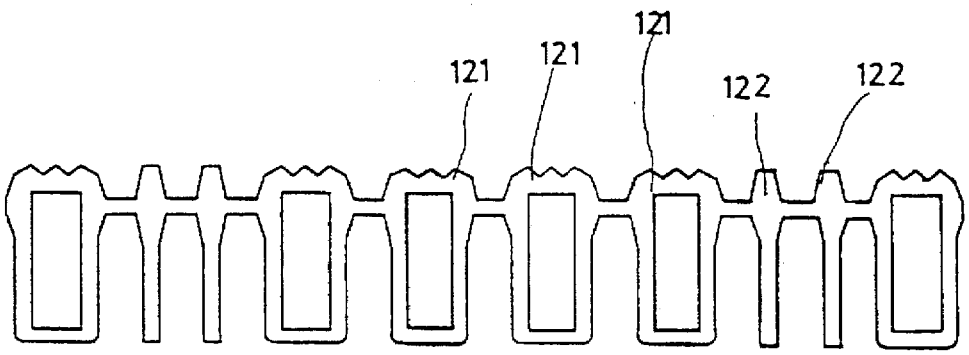
FIG. 26 is a fragmentary, cross-sectional view of the workpiece according to the eleventh embodiment of the present invention before being stretched to form an aluminum mesh.

Please specially refer to FIGS. 25 and 27 in which a part of the aluminum meshes respectively formed from hollow ribs 111, 121 and solid ribs 112, 122 are shown. As can be seen from the drawings, the open spaces defined by the hollow ribs 111, 121 have four considerably big angles which are close to the most preferable angle of 90 degrees. This, however, does not mean that the hollow ribs can be freely stretched to define open spaces of any shape. It only means that the aluminum meshes with interlaced hollow and solid ribs according to the present invention can be formed to have many more varied open spaces on them, including square openings each having four right angles. However, the bigger the angle contained by two hollow ribs, the easier deformed areas are formed on the hollow ribs. In brief, the forming of two widely stretched hollow ribs to contain a bigger angle between them shall be achieved at the expense of possible deformations on the hollow ribs. Such deformations include, for example, laterally squeezed material, a middle sunk area, protuberances, etc., which can be usually found at where the connecting strips and the hollow ribs meet with one another.

What is claimed is:

1. An aluminum mesh with interlaced hollow and solid ribs being formed from an integrally extruded aluminum panel workpiece, said extruded workpiece comprising a plurality of hollow ribs and solid ribs and a plurality of connecting strips, each strip extending between every adjacent two of said ribs and having a plurality of spaced slots formed therein, whereby, said extruded workpiece can be stretched by means of a mesh stretching machine to form said aluminum mesh with interlaced hollow and solid ribs; said aluminum mesh with interlaced hollow and solid ribs comprising a plurality of large open spaces defined by said hollow ribs and a plurality of small open spaces defined by said solid ribs within said large open spaces, such that said hollow and said solid ribs together interlace and define a pattern for said aluminum mesh with interlaced hollow and solid ribs.

2. An aluminum mesh with interlaced hollow and solid ribs as claimed in claim 1, wherein said plurality of hollow and solid ribs on said extruded workpiece are substantially linearly and parallelly arranged in different configurations, whereby a variety of patterns are formed when said extruded workpiece is stretched to expand said slots on said connecting strips and form said aluminum mesh.

3. An aluminum mesh with interlaced hollow and solid ribs as claimed in claim 1, wherein said plurality of hollow and solid ribs have differently shaped cross sections.

* * * * *